US005080434A

United States Patent [19]

Locher

[11] Patent Number: 5,080,434

[45] Date of Patent: Jan. 14, 1992

[54] ADJUSTING MECHANISM FOR AN ADJUSTABLE CHAIR

[75] Inventor: Hermann Locher, Dornach, Switzerland

[73] Assignee: Giroflex Entwicklungs AG, Koblenz, Switzerland

[21] Appl. No.: 380,097

[22] Filed: Jul. 14, 1989

[30] Foreign Application Priority Data

Jul. 15, 1988 [CH] Switzerland ..... 2721/88

[51] Int. Cl.[5] ..... A47C 3/026; F16C 1/10

[52] U.S. Cl. ..... 297/301; 74/501.5 R; 74/502; 74/502.4; 297/361; 297/364

[58] Field of Search ..... 297/300, 301, 302, 304, 297/361, 363, 364, 365; 74/501.5 R, 500.5, 502, 502.4, 110, 128

[56] References Cited

U.S. PATENT DOCUMENTS 2,340,830 2/1944 Arens ..... 74/502 X
4,630,866 12/1986 McFarlane ..... 297/361
4,787,673 11/1988 Locher ..... 297/361 X
4,798,100 1/1989 Baumgarten ..... 74/502.4 X

FOREIGN PATENT DOCUMENTS 8512801 5/1985 Fed. Rep. of Germany .
652902 12/1985 Switzerland .
2195238 4/1988 United Kingdom .

*Primary Examiner*—Peter R. Brown
*Attorney, Agent, or Firm*—EGLI International

[57] ABSTRACT

An adjusting mechanism for an adjustable chair includes a control mechanism, by means of which a control push rod of a spring mechanism is adjusted from a locking position to an unlocking position. In the unlocking position, the chair frame which comprises a seat carrier, a back rest carrier and a pedestal constituted by a pillar and a support part, can undergo a positional adjustment. The locking and unlocking positions are set with a single handle of an operating member which effects a displacement of two control bolts provided with meshing tooth systems, which makes the adjusting mechanism simpler and more advantageous to use.

14 Claims, 2 Drawing Sheets

Fig. 1
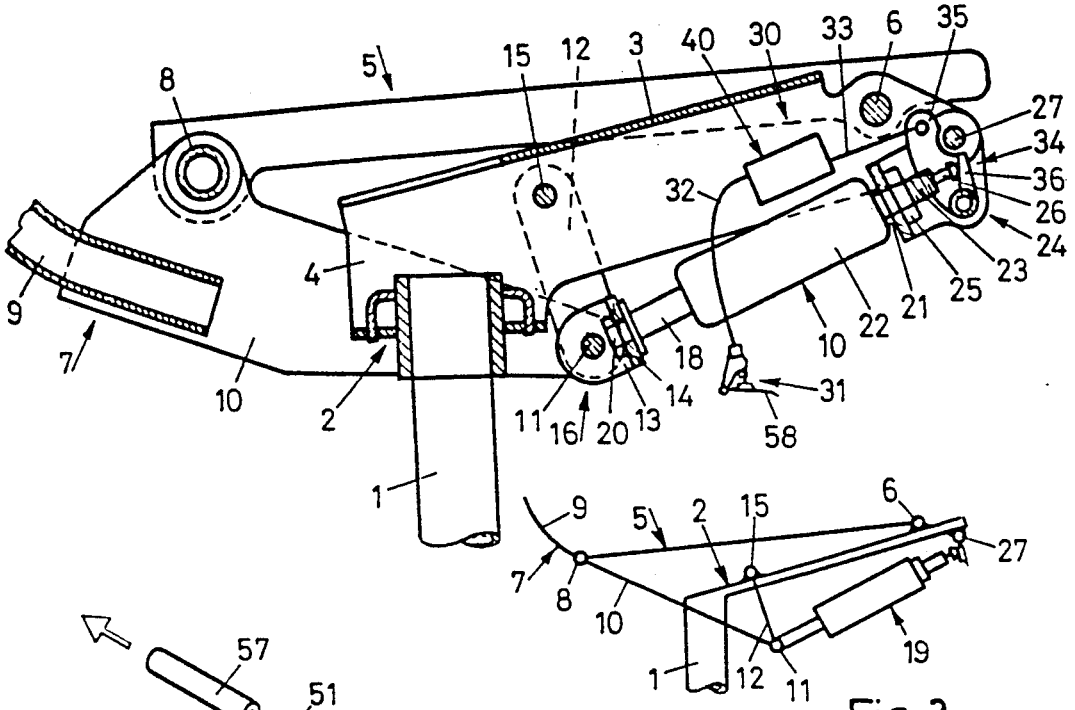
Fig. 2
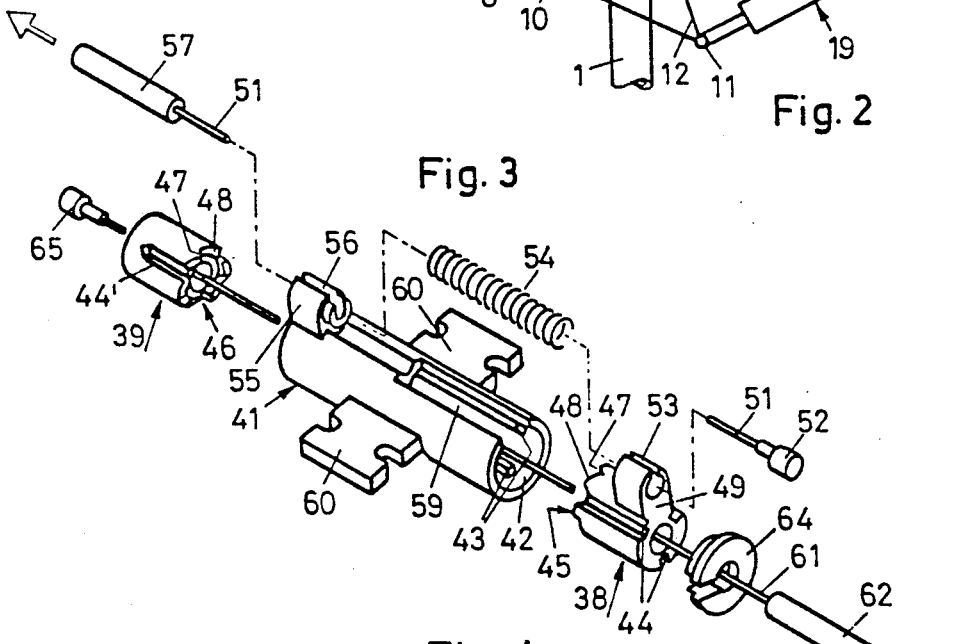
Fig. 3
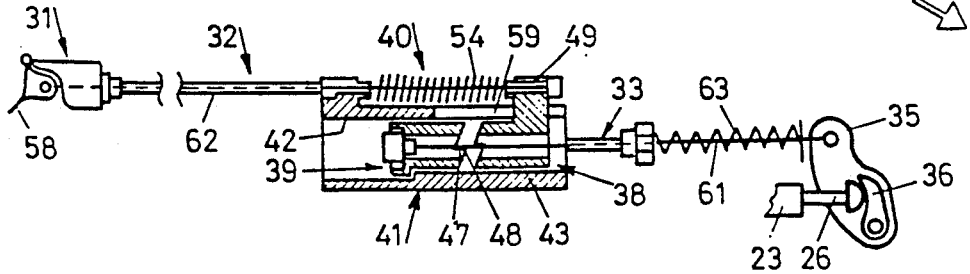
Fig. 4

ADJUSTING MECHANISM FOR AN ADJUSTABLE CHAIR

BACKGROUND OF THE INVENTION

The present invention relates to an adjusting mechanism for an adjustable chair, the frame of which has an adjustable seat carrier and/or an adjustable back rest carrier. Both carriers are supported on a pedestal and together with the latter form the chair frame. A spring mechanism is provided, one end of which is supported on the pedestal and the other end of which is supported on the seat carrier or the backrest carrier and which can be locked and unlocked by a control device.

Chairs with the frame having an adjustable seat carrier and/or an adjustable back rest carrier are known in numerous different designs. The movable part of the chair frame, independently on whether it is in the form of the back rest carrier, the seat carrier or both carriers, must be supported on the pedestal with a spring mechanism, so that it is possible to counteract the force exerted by the chair user. This spring mechanism is e.g. a gas spring or a helical spring.

For increasing sitting comfort, it is known to block the spring mechanism in a particular position of the chair frame and consequently fix the chair position. For this purpose, the chair frame carries an operating mechanism, with which it is possible to block the spring mechanism and therefore the chair frame. The operating mechanism requires two different adjusting levers, namely a first adjusting lever for blocking the spring mechanism and a further adjusting lever for releasing the blocked spring mechanism. This solution is not simple and is not advantageous for the user.

SUMMARY OF THE INVENTION

It is an object of the present invention to provide an improved adjusting mechanism of the aforementioned type, in which the spring mechanism can be locked and unlocked with a single operating mechanism.

According to the invention this and other objects are attained by a device in which the locking and unlocking of the spring mechanism is performed with a single operating member operating the control mechanism. Thus, the control connections for connecting the operating mechanism with the spring mechanism are simplified and operation is facilitated.

BRIEF DESCRIPTION OF THE DRAWINGS

In the drawings:

FIG. 1 is an elevation section through a chair frame;

FIG. 2 is a kinematic equivalent diagram of the chair frame of FIG. 1;

FIG. 3 is an exploded perspective view of a control mechanism for an adjustable chair;

FIG. 4 is a longitudinal section through the casing of the control mechanism of FIG. 3.

DETAILED DESCRIPTION OF THE PREFERRED EMBODIMENTS

Figure 5A:
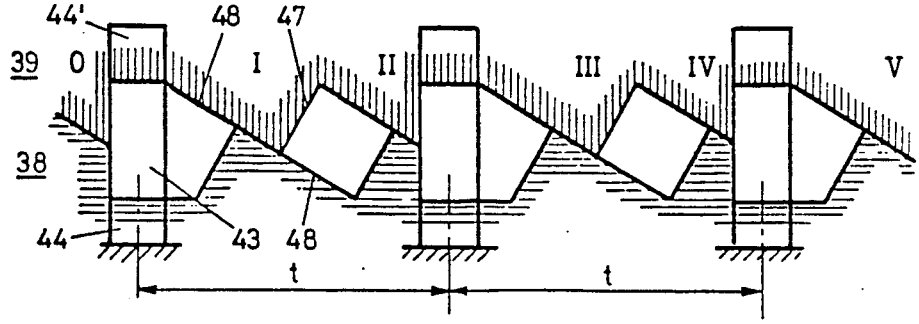
FIGS. 5A to FIG. 5F diagrammatically show the control sequence during the locking and unlocking of the control mechanism according to FIGS. 3 and 4.
Figure 5B:
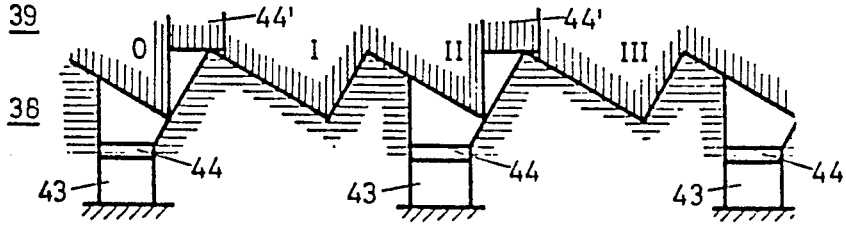
Figure 5C:
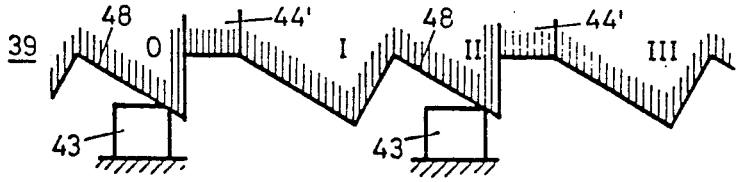
Figure 5D:
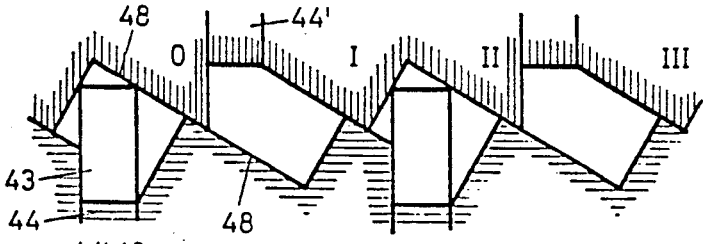

The chair frame shown in FIG. 1 includes a support part 2 mounted on a pillar 1 and constructed as a channel-like hollow shell. The support part 2 has a web 3 with two side walls 4, only one side wall 4 being visible in FIG. 1. At the knee-side end of support part 2, in each case one seat carrier 5 (only one seat carrier 5 is visible in FIG. 1), is pivotably mounted in side walls 4 by means of a first pivot or swivel joint 6. The seat carriers 5 are connected at the back thereof to a back rest carrier 7 by means of a second pivot or swivel joint 8. The second swivel joint 8 can also be constructed as a torsion spring.

The back rest carrier 7 is constructed as a two-armed lever, of which one arm forms the only partly visible back part 9 and the other arm forms a support part 10 extending against the knee-side end. At the free end of support part 10, is provided a third swivel joint 11, on which is, in each case, supported one link 12, which is mounted in rotary manner at one side in a fourth swivel joint 15 located on side walls 4. On the third swivel joint 11, is pivotably mounted one web 13 of an angular clip 16, on the other web 14 of which is firmly screwed one end of a piston rod 18 of a spring mechanism 19 by means of a nut 20. At the other end of the spring mechanism 19, e.g. on the bottom 21 of a cylinder 22 of the spring mechanism 19 constructed as a gas spring, is fixed a threaded bolt 23, which, on the one hand, fixes a second angular clip 24 to a nut 25 and, on the other hand, serves for guiding a control push rod 26. If, as shown in FIG. 1, the spring mechanism 19 is a gas spring, the control push rod 26 locks the spring mechanism 19 in the particular position. However, if the control push rod 26 is moved against cylinder 22, then the spring mechanism is unlocked and the position of the chair frame can be modified.

For operating the control push rod 26, an adjusting mechanism 30 is provided, which includes an operating member 31 connected by means of control connections 32, 33 to a two-armed angle lever 34. One arm 35 of angle lever 34 is coupled to the control connection 33, whilst the other arm 36 acts on the control push rod 26. If, e.g. angle lever 34 is pivoted counterclockwise, then spring mechanism 19 is unlocked, whereas, on pivoting back the angle lever 34 clockwise into its starting position, the spring mechanism 19 is locked.

FIG. 2 is the kinematic equivalent diagram of the chair frame illustrated in FIG. 1 and showing the support part 2, the seat carrier 5 and the back rest carrier 7 as well as other basic components of FIG. 1. It is pointed out that the angular clip 24 on the end of the spring mechanism is articulated with a fifth swivel joint 27 to the knee-side end of support part 2.

The construction, arrangement and function of the adjusting mechanism 30 will be described in connection with FIGS. 3 and 4. The adjusting mechanism 30 includes a control mechanism 40, which essentially comprises a casing 41 and two control bolts 38, 39 which are displaceably guided in a bore 42 of the casing 41.

Axially directed guide webs 43, e.g. three webs distributed over the inner circumference, are located in bore 42 of casing 41 of the adjusting mechanism and operate as a straight-line guide mechanism. Control bolts 38, 39 have corresponding axial grooves 44, 44'. The axial grooves 44 of control bolt 38 extend over the entire length, whereas the axial grooves 44' extend only over part of the length of control bolt 39 and consequently, cf. FIG. 4, form a stop at the end of webs 43.

The oppositely directed ends of control bolts 38, 39 have each a tooth system 45, 46 formed from steep and shallow sides. The function of the tooth systems 45, 46 will be explained in connection to FIG. 5. On control bolt 38 is arranged a driving arm 49, in which is fixed the control connection 32 in the form of a wire 51 of a Bowden cable. As can be seen from FIG. 3, wire 51 has a retaining head 52, which is inserted in a groove 53 of driving arm 49. The wire 51 is located in a compression spring 54 and is subsequently guided in a support base 55 having a groove 56, on which is supported the compression spring 54. Outside the support base 55, wire 51 is guided in a flexible guide tube 57, which is fixed to the operating member 31, whereas wire 51 is fixed to a pivotable handle 58 thereof. By pulling the handle 58, the control bolt 38 can be moved in the direction counter to the direction of tension of compression spring 54. A slit 59 is provided for this purpose on the top of the casing 41, which has two fixing tabs 60 enabling it to be fixed to the support part 2. However, only one fixing tab 60 can be used.

The other control bolt 39 is connected by the second control connection 33 made in the form of a second Bowden cable, to arm 35 of the angle lever 34. The second Bowden cable 33 comprises a wire 61 and a guide tube 62 which is supported on a front cover 64 of casing 41. On wire 61, on the end of which the control bolt 39 is supported on a head 65, is arranged a compression spring 63, which is supported with one end on the guide tube 62 and with its other end on the arm 35, cf. FIG. 4. Thus, the compression spring 63 exerts a force in a clockwise direction on arm 35, cf. FIG. 4 so that the control push rod 26 can move into the locking position of spring mechanism 19. Simultaneously, a tensile stress is exerted on the control bolt 39, through which it can strike against the ends of webs 43. If the control bolt 39 is now moved over and beyond webs 43 by pulling handle 58 and is then turned so that its axial grooves 44' are displaced with respect to the axial webs 43 of casing 41, the control bolt 39 assumes the position, in which the push rod 26 unlocks the spring mechanism 19. By a further operation of handle 58, the control bolt 39 is raised and -; turned again until its axial grooves 44' are aligned with webs 43 and then, on releasing handle 58, the control bolt 39 can move back into its starting position, in which the control push rod 26 can return to the locking position of the spring mechanism. The rotation performed by the control bolt 39 corresponds to a web spacing t.

The rotary movement of control bolt 39 is obtained by the tooth system 45, 46, as will be explained in reference to FIGS. 5A-5F, in which the two control bolts 38, 39 are shown in the rolled-out position. The axial webs 43 and axial grooves 44, 44' are also shown in FIGS. 5A-5F.

FIG. 5A diagrammatically shows the position of the adjusting mechanism 30, in which the spring mechanism 19 is locked. The two control bolts 38, 39 with their respective axial grooves 44, 44' are located in the vicinity of the axial guide webs 43. By pulling handle 58, the control bolt 38 is raised until the control bolt 39 is located above the ends of the axial guide webs 43. The shallow sides 48 can be moved towards one another, because control bolt 39 is under the action of compression spring 63. Control bolt 39 consequently rotates into the position shown in FIG. 5B. Handle 58 is now released, so that the control bolt 38 moves away from control bolt 39, cf. FIG. 5C and slides downwards with its shallow side 48 on axial webs 43, and with simultaneous rotation, cf. FIG. 5D. Thus, the rotatable control bolt 39 has performed two partial rotations.

Figure 5E:
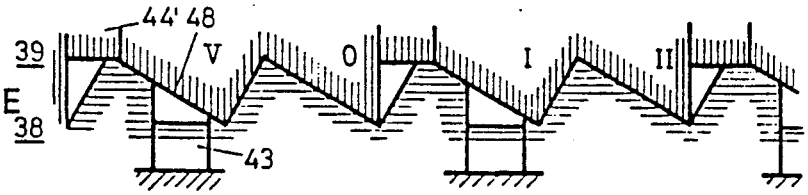
Figure 5F:
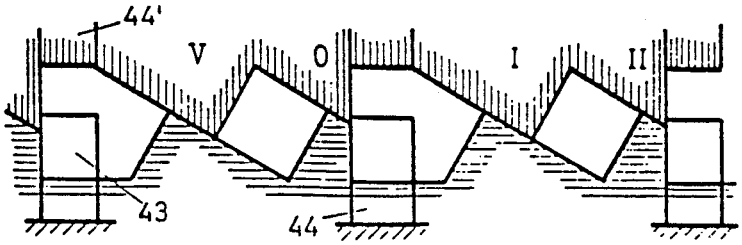

If handle 58 is now pulled again, control bolt 38 moves against control bolt 39, raises it over the end of the axial webs 43, so that the shallow sides 48 can slide on one another and bolt 39 performs a further partial rotation, cf. FIG. 5E. Handle 58 is now released, control bolt 38 moves back and frees the end of axial web 43. Consequently, control bolt 39 is rotated until the side of axial groove 44' of control bolt 39 strikes against the ends of axial webs 43, cf. FIG. 5F. Both control bolts 38, 39 can now slide back along the axial webs 43 into position shown in FIG. 5F corresponding to the initial position of FIG. 5A.

It is assumed in FIGS. 5A-5F that three axial webs 43 are distributed over the inner circumference of casing 41. Six teeth are then required for the tooth system with a steep side 47 and a shallow side 48. The number of axial webs 43 can be chosen at random and correspondingly there can be twice the number of teeth in tooth system 45, 46.

There has been disclosed heretofore the best embodiment of the invention presently contemplated. However, it is to be understood that various changes and modifications may be made thereto without departing from the spirit of the invention.

What is claimed is:

1. An adjusting mechanism for an adjustable chair of the type including a chair frame having an adjustable seat carrier and a back rest carrier, said seat and back rest carrier being supported on a pedestal and forming therewith said chair frame, the adjusting mechanism comprising a spring mechanism having one end which is supported on the pedestal and another end supported on one of said carriers and adapted to be locked and unlocked;

a user operating member to actuate the locking and unlocking of said spring mechanism; and a control mechanism being operatively connected to said user operating member and said spring mechanism by mechanical control connections, and having a casing and two control bolts mounted therein, one of said control bolts being axially displaceable therein in response to the actuation of the user operating member, each of said control bolts having a respective end face with tooth meshing means thereon, each of the respective end faces abutting against the other end face, wherein the respective tooth meshing means rotationally slide to a locking position and an unlocking position in response to the axial displacement of said one of said control bolts.

2. Adjusting mechanism according to claim 1, wherein said control mechanism is arranged between said single operating member and said spring mechanism, said spring mechanism being controllable by a handle of said operating member in a locking and an unlocking position, said spring mechanism including a control push rod connected to said control mechanism.

3. Adjusting mechanism according to claim 2, wherein each tooth system has teeth provided with a steep side and a shallow side.

4. Adjusting mechanism according to claim 2, wherein one of said control bolts is displaceable by said operating member on a straight-line guide provided in said casing, and another of said control bolts being positioned in said guide during a partial displacement stroke and being rotatable, after leaving said straight-line guide, upon sliding on the shallow sides of said tooth system.

5. Adjusting mechanism according to claim 4, wherein said straight-line guide includes axial webs formed on said casing and spaced apart over an inner circumference of said casing, and the number of said webs being half the number of teeth of said tooth systems of said control bolts.

6. Adjusting mechanism according to claim 5, wherein said webs are circumferentially spaced at a web spacing (t) so that said another control bolt, upon two control movements of said operating member, passes from one locking position into another locking position which is offset from said one locking position by one web spacing (t) and between the two control movements, said another control bolt is positioned outside said straight-line guide but is supported thereby so as to hold said control push rod of said spring mechanism in the unlocked position.

7. Adjusting mechanism according to claim 4, wherein said control mechanism further includes spring members associated with said control connections, one of said spring members retracting said operating member into its starting position and another of said spring members pressing on said another control bolt and thus supplying a force for the rotary movement of said another control bolt.

8. Adjusting mechanism according to claim 4, wherein said control bolts have circumferentially spaced axial grooves which in one control bolt extend over the entire length thereof and in another control bolt extend over part of the length thereof.

9. Adjusting mechanism according to claim 1, wherein said control connections are Bowden cables.

10. An adjusting mechanism for an adjustable chair of the type including a chair frame having an adjustable seat carrier and a back rest carrier, said seat and back rest carrier being supported on a pedestal and forming therewith said chair frame, the adjusting mechanism comprising a spring mechanism;

a control mechanism, said spring mechanism having one end which is supported on the pedestal and another end supported on one of said carriers and adapted to be locked and unlocked by said control mechanism, and a single operating member connected to and operating said control mechanism to perform the locking and unlocking of said spring mechanism;

wherein said control mechanism is arranged between said single operating member and said spring mechanism, said spring mechanism being controllable by handle of said operating member in a locking and an unlocking position, said spring mechanism including a control push rod connected to said control mechanism;

wherein said control mechanism comprises a casing and two control bolts cooperating with one another and each having abutting end faces and being displaceably mounted in said casing, said abutting end faces being provided each with a meshing tooth system meshing with the tooth system of the cooperating control bolt; and wherein one of said control bolts is displaceable by said operating member on a straight-line guide provided in said casing, and another of said control bolts being positioned in said guide during a partial displacement stroke and being rotatable, after leaving said straight-line guide, upon sliding on the shallow sides of said tooth system.

11. Adjusting mechanism according to claim 10, wherein said straight-line guide includes axial webs formed on said casing and spaced apart over an inner circumference of said casing, and the number of said webs being half the number of teeth of said tooth systems of said control bolts.

12. Adjusting mechanism according to claim 11, wherein said webs are circumferentially spaced at a web spacing (t) so that said another control bolt, upon two control movements of said operating member, passes from one locking position into another locking position which is offset from said one locking position by one web spacing (t) and between the two control movements, said another control bolt is positioned outside said straight-line guide but is supported thereby so as to hold said control push rod of said spring mechanism in the unlocked position.

13. Adjusting mechanism according to claim 10, wherein said control mechanism further includes spring members associated with said control connections, one of said spring members retracting said operating member into its starting position and another of said spring members pressing on said another control bolt and thus supplying a force for the rotary movement of said another control bolt.

14. Adjusting mechanism according to claim 10, wherein said control bolts have circumferentially spaced axial grooves which in one control bolt extend over the entire length thereof and in another control bolt extend over part of the length thereof.

* * * * *